United States Patent [19]

Taziker

[11] 4,195,687

[45] Apr. 1, 1980

[54] SPACE HEATING PANELS

[76] Inventor: Robert E. Taziker, 248 Cherry Tree Rd., Blackpool, Lancashire, England

[21] Appl. No.: 859,669

[22] Filed: Dec. 12, 1977

[51] Int. Cl.[2] ..... F24H 3/00; F28F 1/30

[52] U.S. Cl. ..... 165/129; 165/182; 219/365; 219/530

[58] Field of Search ..... 165/128, 129, 182; 219/365, 341, 530, 540, 367, 368

[56] References Cited

U.S. PATENT DOCUMENTS

| | | | |
|---|---|---|---|
| 1,829,241 | 10/1931 | Shurtleff | 165/129 |
| 1,957,703 | 5/1934 | Davis, Jr. et al. | 165/129 |
| 3,033,536 | 5/1962 | Guszmann | 165/129 |

FOREIGN PATENT DOCUMENTS

| | | | |
|---|---|---|---|
| 725124 | 7/1942 | Fed. Rep. of Germany | 165/182 |
| 2413766 | 10/1974 | Fed. Rep. of Germany | 165/129 |
| 871822 | 5/1942 | France | 165/128 |
| 1219296 | 5/1960 | France | 165/129 |

*Primary Examiner*—Sheldon Richter
*Attorney, Agent, or Firm*—Harrington A. Lackey

[57] ABSTRACT

The invention provides a heating panel which is made up of a plurality of heat conducting elongated plates. The plates are profiled in cross-section so as to be of Z-shape and they are pushed together so as to lie lengthwise parallel. The web portions abut for the current submission of heat between the plates, and there is a heating pipe passing through apertures in the plates and which is in heat conducting engagement with said plates.

6 Claims, 6 Drawing Figures

SPACE HEATING PANELS

This invention relates to space heating panels for use in rooms, buildings, offices and the like.

Conventional space heating panels (radiators) used in domestic central heating systems comprise pressed steel plates welded together, so as to define passages therein, through which hot water is circulated, in order to heat the plates, which in turn radiate heat into the space to be heated.

Such radiators have a number of drawbacks, amongst which are, that they do not effect any appreciable amount of heating of the space by convection, and moreover, the plates tend to become uncomfortably hot to the touch, which is dangerous particularly when young children occupy the space being heated. Furthermore, in order to meet the space heating requirements of a room, these radiators take up a large amount of wall space, which is a serious disadvantage expecially in modern homes where, by and large, rooms are being made smaller.

There is also available a space heating panel which functions as a convection heater and because of this it does not require as much wall space as the conventional radiator described above. This panel comprises a heating pipe (through which the water is circulated) sandwiched between two metal plates to which the pipe is welded, in order that the plates will be heated by the pipe, and the plates are louvered so that upwardly moving air close to its panel front is deflected into the front of the panel, through it, so that it contacts the heating coil and is heated thereby, and then through the rear of the panel into a convection space, wherein it travels upwardly and into the room to be heated. This panel is a very effective heater, but is expensive to produce, at least in small quantities, and an object of the present invention is to provide a heating panel which will be an effective space heater without having the disadvantage of conventional radiators and which will be cheap to produce in small quantities.

In accordance with the present invention there is provided a heating panel comprising a plurality of heat conducting elongated plates of profiled cross section, each plate having a first and second web portions at opposite sides of a flange portion so that there is defined in the cross section of the plate a Z shape, the plates being pushed together with their lengthwise directions parallel so that the adjacent web portions abut and the flanges lie generally in a common plane, the panel further including one or more lengths of heating pipe passing through apertures in the first web portions of the plates and being in heat conducting engagement therewith.

Preferably, there will be a plurality of lengths of heating pipe lying parallel to each other and at right angles to the length directions of the profiled plates, the ends of the pipe lengths being connected by pipe bends so that a continuous heating pipe winding sinuously through the plates is defined, the ends of such continuous heating pipe being arranged suitably for connection of the panel in a central heating system.

The passages defined between adjacent first and second web portions in the panel serve as convection passages for the upward drift of air, as the plates will be arranged to extend vertically in use, with the said pipe lengths lying horizontally.

The plates are preferably provided with front and rear portions extending from the edges of the first and second web portions respectively opposite the edges of said first and second web portions which are connected to the edges of the flange portion so that the front and rear portions of the plates together respectively define front and rear faces of the panel. The abutting contact between said first and second web portions makes for the better conduction of heat from the pipe lengths to the front and rear faces of the panel.

The pipe lengths preferably are of copper suitable for carrying heating fluid e.g. water at a temperature of 180° F.

The pipe length or lengths may be expanded into heat conducting engagement with the first web portions and this may be done, prior to the connection thereto of the pipe bends, by drawing a bullet expander therethrough. The expansion of 15 mm dia copper pipe lengths may be of the order of 20 thousandths of an inch.

The front, rear and flange portions of the plates may be provided with louvres in order to cause flow of air through the panel in addition to up the inside of the panel if desired.

The plates preferably are of metal.

Embodiments of the present invention will now be described, by way of example, with reference to the accompanying diagrammatic drawings, wherein:-

Figure 1:
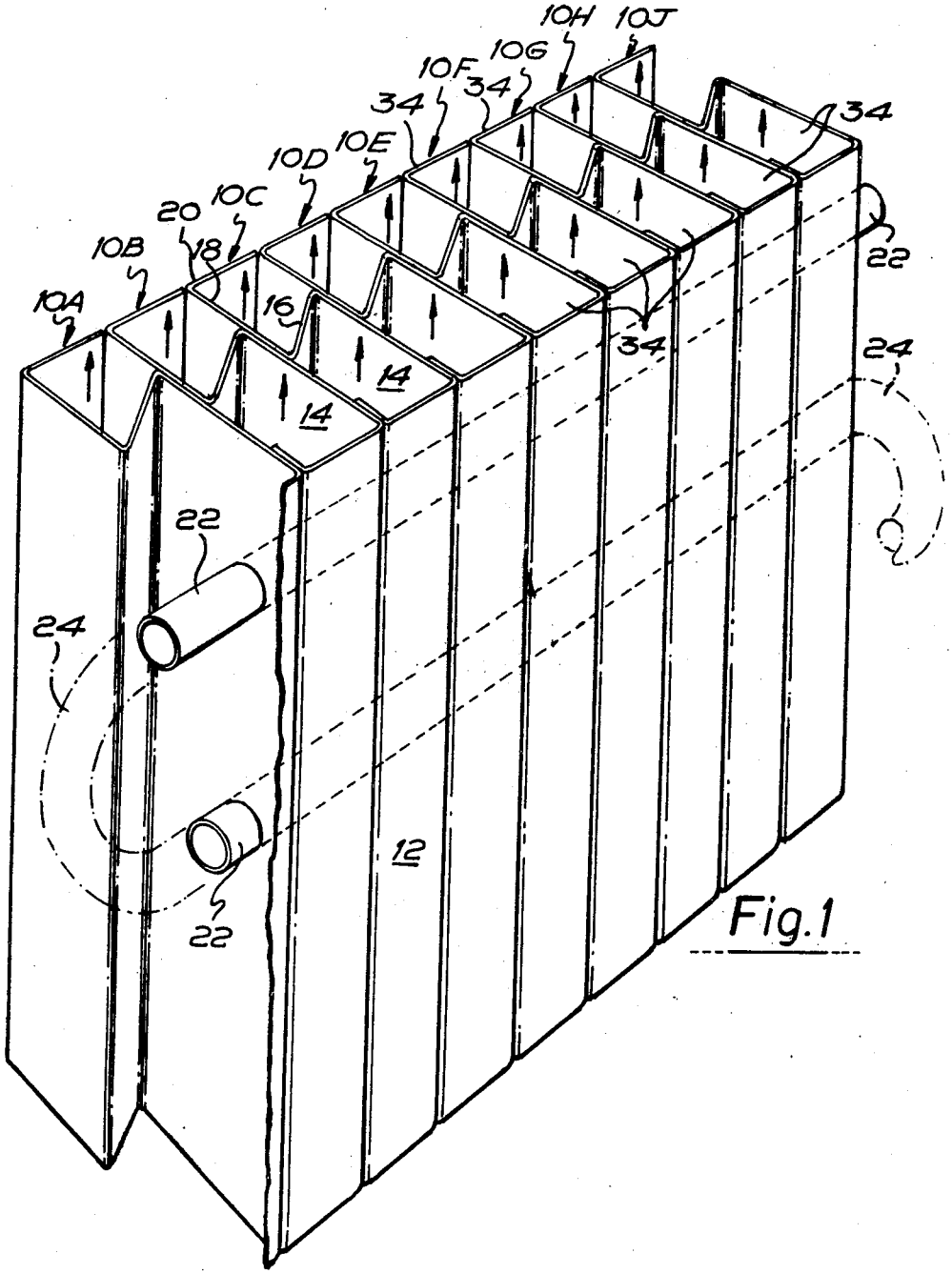
FIG. 1 shows a perspective view of the elements of a panel in accordance with one embodiment of the present invention.
Figure 2:
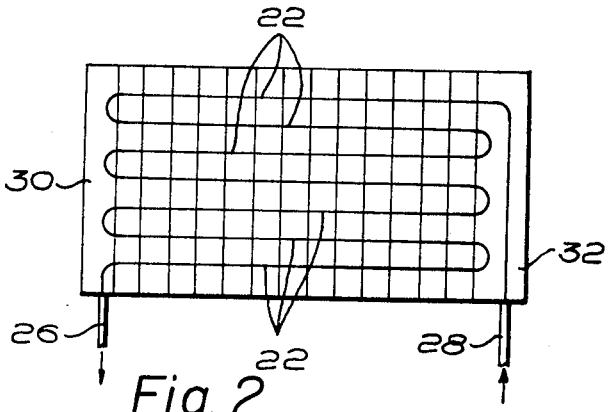
FIG. 2 is a side view showing the complete panel.
Figure 3:
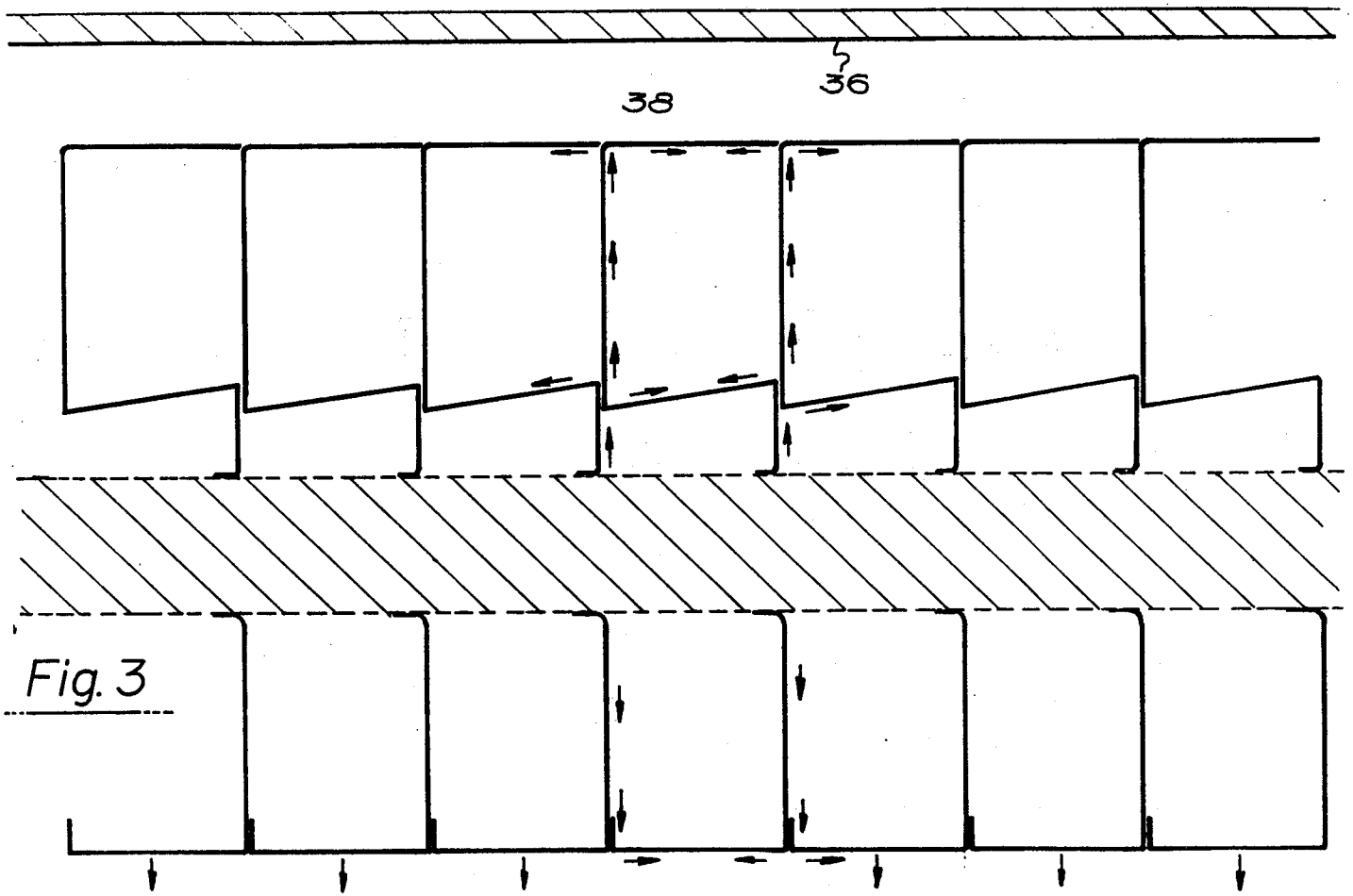
FIG. 3 is a plan of the portion of the panel shown in FIG. 1.

Referring firstly to FIGS. 1, 2 and 3, the panel of the embodiment of the invention comprises a pack of profile plates 10A, 10B, 10C and so on which are of identical configuration. These plates are of metal and are elongated and, in the panel, are arranged so that their lengths directions are parallel. The sections are in face to face contact as will be described and in use will be arranged upright as shown in FIGS. 1 and 2. As can be seen clearly, each of the profiled plates 10 defines a z configuration comprising a first web portion 14, a flange portion 16, and a second web portion 18. Additionally each plate has a front portion 12 and a rear portion 20. The flange portion 16 is bent through more than 270° relative to the first web portion 14 so that when the plates are arranged in face to face relationship as shown in FIG. 1, the second web portion 18 abuts the first web section 14 of the adjacent profiled plate and this contact takes place between front and rear faces of the panel respectively defined by the front portions 12 and the rear portions 20. If reference is made to FIG. 3, it will be seen by the illustration of the temperatures at the various portions 12 to 20 how the heat is conducted from heating pipe lengths 22 which carry the heating fluid, e.g. water, and which pass through the first side portions 14 as shown in FIG. 1.

These heating pipe lengths 22 are copper and are arranged in parallel but normal to the length direction of the pack of plates 10. Each pipe length 22 passes through apertures in and is expanded into firm frictional engagement with the first web portions 14. The expansion may be by, for example, the passage of a bullet expander therethrough. Thus, in order to erect the panel shown in FIG. 1, the plate sections 10 arranged in face to face contact as described and the pipe lengths 22 are placed in position. It should be noted that as many pipe lengths 22 as are required will be provided in the panel. Next, each pipe length 22 is expanded by drawing a bullet expander therethrough so that the pipe lengths 22 become firmly frictionally engaged with the first web portions. The lengths 22 are interconnected by pipe bends 24 shown in chain dotted lines in FIG. 1 in order to provide a continuous and sinuously winding heating pipe. If reference is made to FIG. 2 it will be seen that the ends 26 and 28 of the heating pipe are brought out of the bottom of the heating panel, and the bends 24 are covered by end boxes 30 and 32. To complete the panel, the top may be covered by an apertured plate. It is important that such plate, if provided, be apertured in order to allow the passage therethrough of convected air which in use of the heating panel will move up through the passages 34 defined by the metal plates 10.

In a particular example, the continuous heating pipe will carry water at a temperature of 180° F. The tube lengths 22 are initially of 15 mm diameter and are expanded by 20 thousandths of an inch. This arrangement will provide the temperature distribution along the lengths of the cross section of the plates as shown in FIG. 3 so that the front face of the panel will reach a temperature of 145°, whilst the rear face reaches a temperature of 135°. FIG. 3 shows the panel arranged adjacent a wall 36 and between the wall and the panel there is created another convection space 38 up which air will travel in use of the panel.

The panel described has the following advantages. Firstly, it can quickly get up to temperature by using a basically copper heating pipe, it can be made much narrower than a conventional radiator for giving the same heat output, as it serves not only as a means of radiating heat but also as a means of heating by convection. In addition, it can be manufactured very cheaply as will be appreciated from the above description.

Figure 4:
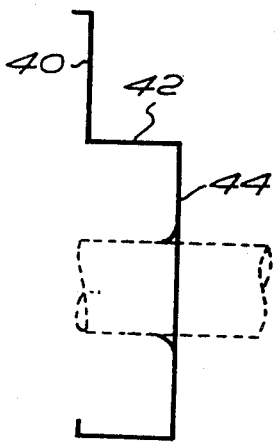
FIGS. 4 and 5 show alternative embodiments of panel plate configurations.
Figure 5:
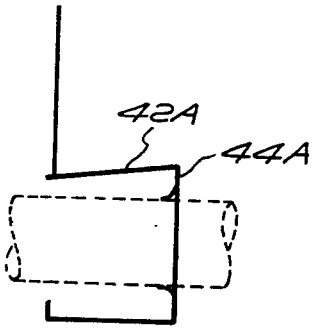

The invention is not limited to the utilization of profiled plates of the cross section illustrated in FIG. 1 and in FIG. 3, and FIGS. 4 and 5 and 6 show alternative profiled sections. In FIG. 4 a U-shaped channel section is used but it is provided with an additional fin 40 and a portion 42, portions 40, 42 and 44 defining the Z shape and portion 42 again is bent through more than 270° relative to portion 44 so that portion 40 will be in face to face contact with the portion 44 of the adjacent section. The section shown in FIG. 5 is basically similar to the section shown in FIG. 4 except that the portion 42A is made broader whilst the portion 44A is made narrower. The variation in the size of these portions is to provide for heat radiation according to requirements.

Figure 6:
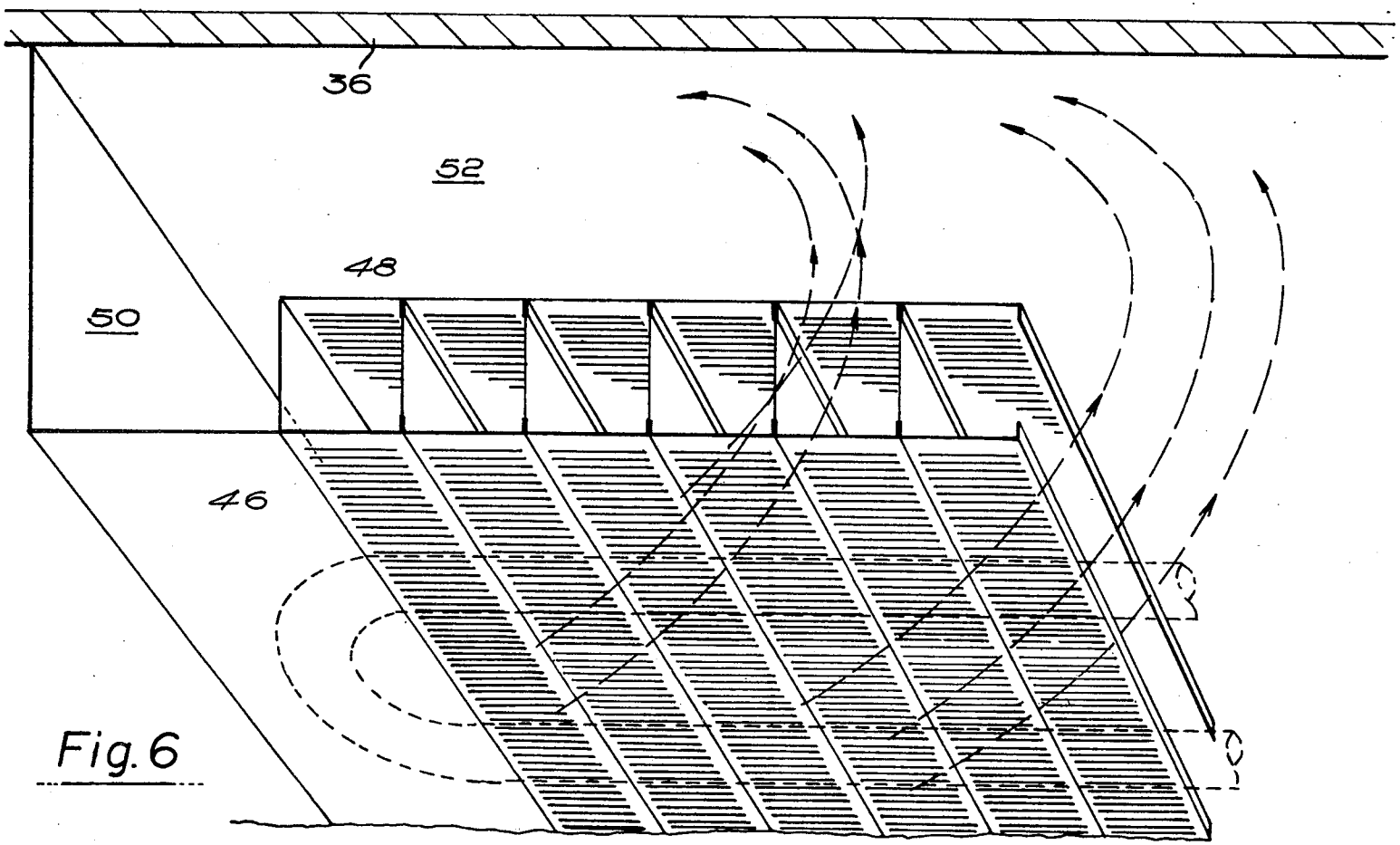
FIG. 6 is a perspective view illustrating the modification of a panel according to the invention to cause air flow therethrough.

In FIG. 6 there is shown a section of the panel according to the invention when provided with the profiled plate as shown in FIG. 1 to 3 but in addition this Figure also shows that the front, rear and flange portions of each profile plate have been provided with louvres 46, 47 and 48 respectively. In addition, the panel is used with a box plate 50 in order to create a substantial convection space 52 between the panel and the wall 36. In use, this panel has the effect of drawing in air through the louvres 46 and 47 and causing it to flow out through louvres 48 and into the space 52 as indicated by the arrows. The heated air subsequently moves in substantial volumes by convection up and out of space 52 into the room to be heated. These louvres can be provided in either of the embodiments hereinbefore described with reference to FIGS. 4 and 5 in order to achieve this convection effect.

In the prototype versions of panels in accordance with the invention, we have used mild steel for the profiled plates, but it is possible to use other metallic materials or other heat conductive materials. It is also possible to use materials other than copper for the pipe lengths 22.

The ends 26 and 28 of the continuous heating pipe will of course be provided with the usual connections to enable it to be connected to a conventional, central heating system.

I claim:

1. A heating panel comprising a plurality of similar heat conducting elongated plates, each plate having a defined length direction and being profiled in cross section transverse to said length direction, each plate having first and second web portions in parallel planes at opposite sides of a flange portion so that there is defined in said cross section of the plate transverse to said length direction a Z shape, the plates being pushed together with their lengthwise directions parallel so that each of said first web portions abut the second web portions of adjacent plates, each of said flange portions lying in a different single plane, said single planes being parallel and inclined relative to the planes containing the first and second web portions, the panel further including one or more lengths of heating pipe passing through apertures in the first web portions of the plates and being in heat conducting engagement therewith.

2. A heating panel according to claim 1, wherein there is a plurality of lengths of heating pipe lying parallel to each other and at right angles to the length directions of the profiled plates.

3. A heating panel according to claim 2, wherein the ends of the pipe lengths are connected by pipe bends so that a continuous heating pipe winding sinuously through the plates is defined, the ends of such continuous heating pipe being arranged suitably for connection of the panel in a central heating system.

4. A heating panel according to claim 1, wherein the plates are provided with front and rear portions extending from the edges of the first and second web portions respectively opposite the edge of said first and second web portions which are connected to the edges of the flange portion, so that the front and rear portions of the plates together respectively define front and rear faces of the panel.

5. A heating panel according to claim 4, wherein the front, rear and flange portions of the plates are provided with louvres in order to cause flow of air through the panel.

6. A heating panel according to claim 1 in which each of said lengths of heating pipe is expanded into heat conducting engagement with said first web portions.

* * * * *